US010641562B2

(12) United States Patent
Patrick, IV

(10) Patent No.: US 10,641,562 B2
(45) Date of Patent: May 5, 2020

(54) FIREARM WITH RECOIL MITIGATION

(71) Applicant: James Robert Patrick, IV, Charles Town, WV (US)

(72) Inventor: James Robert Patrick, IV, Charles Town, WV (US)

( * ) Notice: Subject to any disclaimer, the term of this patent is extended or adjusted under 35 U.S.C. 154(b) by 0 days.

(21) Appl. No.: 16/390,622

(22) Filed: Apr. 22, 2019

(65) Prior Publication Data

US 2020/0025470 A1 Jan. 23, 2020

Related U.S. Application Data

(60) Provisional application No. 62/688,447, filed on Jun. 22, 2018.

(51) Int. Cl.

| | |
|---|---|
| ***F41A 3/56*** | (2006.01) |
| ***F41A 5/10*** | (2006.01) |
| ***F41A 5/12*** | (2006.01) |
| ***F41A 3/72*** | (2006.01) |

(52) U.S. Cl.

CPC . *F41A 3/56* (2013.01); *F41A 3/72* (2013.01)

(58) Field of Classification Search

CPC ..... F41A 1/08; F41A 3/12; F41A 3/70; F41A 3/78; F41A 3/80; F41A 3/82; F41A 3/84; F41A 3/86; F41A 3/88; F41A 3/90; F41A 3/92; F41A 3/94; F41A 3/34; F41A 3/56; F41A 5/10; F41A 5/12

See application file for complete search history.

(56) References Cited

U.S. PATENT DOCUMENTS

| | | | | |
|---|---|---|---|---|
| 3,756,121 A * | 9/1973 | Roy | F41A 3/86 | 89/196 |
| 4,593,601 A * | 6/1986 | Smith | F41A 3/82 | 89/196 |
| 5,054,368 A * | 10/1991 | Wentzel | F41A 3/86 | 89/196 |
| 5,164,534 A * | 11/1992 | Royster | F41A 3/80 | 89/1.4 |
| 5,581,046 A * | 12/1996 | Weldle | F41A 5/04 | 89/196 |
| 5,741,996 A * | 4/1998 | Ruger | F41A 3/66 | 89/196 |
| 6,257,116 B1 * | 7/2001 | Moczijdlower | F41A 5/34 | 42/26 |

(Continued)

*Primary Examiner* — Derrick R Morgan

(74) *Attorney, Agent, or Firm* — Bennet K. Langlotz; Langlotz Patent & Trademark Works, LLC

(57) ABSTRACT

Firearms with recoil mitigation have a frame with a connected slide, the slide configured to reciprocate relative to the frame along a slide reciprocation path, the slide having a ramp surface angularly offset from the slide reciprocation path by a first angle, a follower element connected to the frame and configured to reciprocate with respect to the frame along a follower path, the follower being biased toward the slide, and the follower having a slide contact portion configured to contact the ramp surface of the slide, such that reciprocation of the slide generates reciprocation of the follower element. The reciprocation of the slide may define a horizontal plane. The ramp surface may face downwardly and rearwardly. The slide may include a top panel and opposed downwardly-depending side panels each having lower edges. The ramp surface may be formed in a cutout above the lower edge of a side panel.

15 Claims, 6 Drawing Sheets

(56) References Cited

U.S. PATENT DOCUMENTS

| | | | | |
|---|---|---|---|---|
| 8,037,805 | B1 * | 10/2011 | Neroni | F41A 3/28 89/196 |
| 8,122,633 | B2 * | 2/2012 | Kerbrat | F41A 1/08 42/20 |
| 8,418,389 | B1 * | 4/2013 | Lukman | F41A 5/10 42/1.06 |
| 8,539,706 | B1 * | 9/2013 | Vieweg | F41A 3/82 42/1.06 |
| 2005/0247187 | A1 * | 11/2005 | McGarry | F41A 3/86 89/198 |
| 2010/0031812 | A1 * | 2/2010 | Kerbrat | F41A 5/12 89/190 |
| 2012/0240760 | A1 * | 9/2012 | Pizano | F41A 3/26 89/191.01 |
| 2013/0087130 | A1 * | 4/2013 | Hu | F41B 11/721 124/60 |
| 2014/0053445 | A1 * | 2/2014 | Wolf | F41A 3/12 42/14 |
| 2014/0196337 | A1 * | 7/2014 | Bandini | F41A 3/44 42/16 |
| 2014/0317982 | A1 * | 10/2014 | Gentilini | F41A 3/12 42/16 |
| 2015/0354910 | A1 * | 12/2015 | Kerbrat | F41A 3/64 42/16 |
| 2016/0047613 | A1 * | 2/2016 | Hudson, III | F41A 3/86 42/14 |
| 2016/0138882 | A1 * | 5/2016 | Curry | F41A 21/00 89/14.05 |
| 2016/0245601 | A1 * | 8/2016 | Kedairy | F41A 3/86 |
| 2018/0073825 | A1 * | 3/2018 | Zukowski | F41C 3/00 |
| 2019/0195582 | A1 * | 6/2019 | Thomele | F41A 9/38 |
| 2020/0025470 | A1 * | 1/2020 | Patrick, IV | F41A 3/72 |

* cited by examiner

FIREARM WITH RECOIL MITIGATION

CROSS-REFERENCE TO RELATED APPLICATION

This application claims the benefit of U.S. Provisional Patent Application No. 62/688,447 filed on Jun. 22, 2018, entitled "FIREARM WITH RECOIL MITIGATION," which is hereby incorporated by reference in its entirety for all that is taught and disclosed therein.

FIELD OF THE INVENTION

The present invention relates to firearms and more particularly to a firearm with recoil mitigation.

BACKGROUND OF THE INVENTION

When fired, blowback firearms produce a recoil impulse along the axis of the rearward-moving bolt or slide. In the case of a modern handgun, the slide's axis of travel is offset from the axis of the user's arm, so the recoil impulse creates a moment which turns the muzzle of the handgun upward. This undesirable muzzle rise can make maintaining the sight picture difficult, which can create inaccuracy as subsequent rounds are fired, especially with a fully-automatic firearm.

Therefore, a need exists for a new and improved firearm with recoil mitigation that has a secondary moving mass that both slows the rearward movement of the slide and imparts a downward recoil to the firearm, thereby preventing the muzzle from climbing significantly with each shot. In this regard, the various embodiments of the present invention substantially fulfill at least some of these needs. In this respect, the firearm with recoil mitigation according to the present invention substantially departs from the conventional concepts and designs of the prior art, and in doing so provides an apparatus primarily developed for the purpose of providing a firearm with recoil mitigation that prevents the muzzle from climbing significantly with each shot.

SUMMARY OF THE INVENTION

The present invention provides an improved firearm with recoil mitigation, and overcomes the above-mentioned disadvantages and drawbacks of the prior art. As such, the general purpose of the present invention, which will be described subsequently in greater detail, is to provide an improved firearm with recoil mitigation that has all the advantages of the prior art mentioned above.

To attain this, the preferred embodiment of the present invention essentially comprises a frame, a slide connected to the frame, the slide configured to reciprocate relative to the frame along a slide reciprocation path, the slide having a ramp surface angularly offset from the slide reciprocation path by a first angle, a follower element connected to the frame and configured to reciprocate with respect to the frame along a follower path, the follower being biased toward the slide, and the follower having a slide contact portion configured to contact the ramp surface of the slide, such that reciprocation of the slide generates reciprocation of the follower element. The reciprocation of the slide may define a horizontal plane, and the ramp surface may face downwardly and rearwardly. The slide may include a top panel and opposed downwardly-depending side panels each having lower edges, and the ramp surface may be formed in a cutout above the lower edge of one of the side panels. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
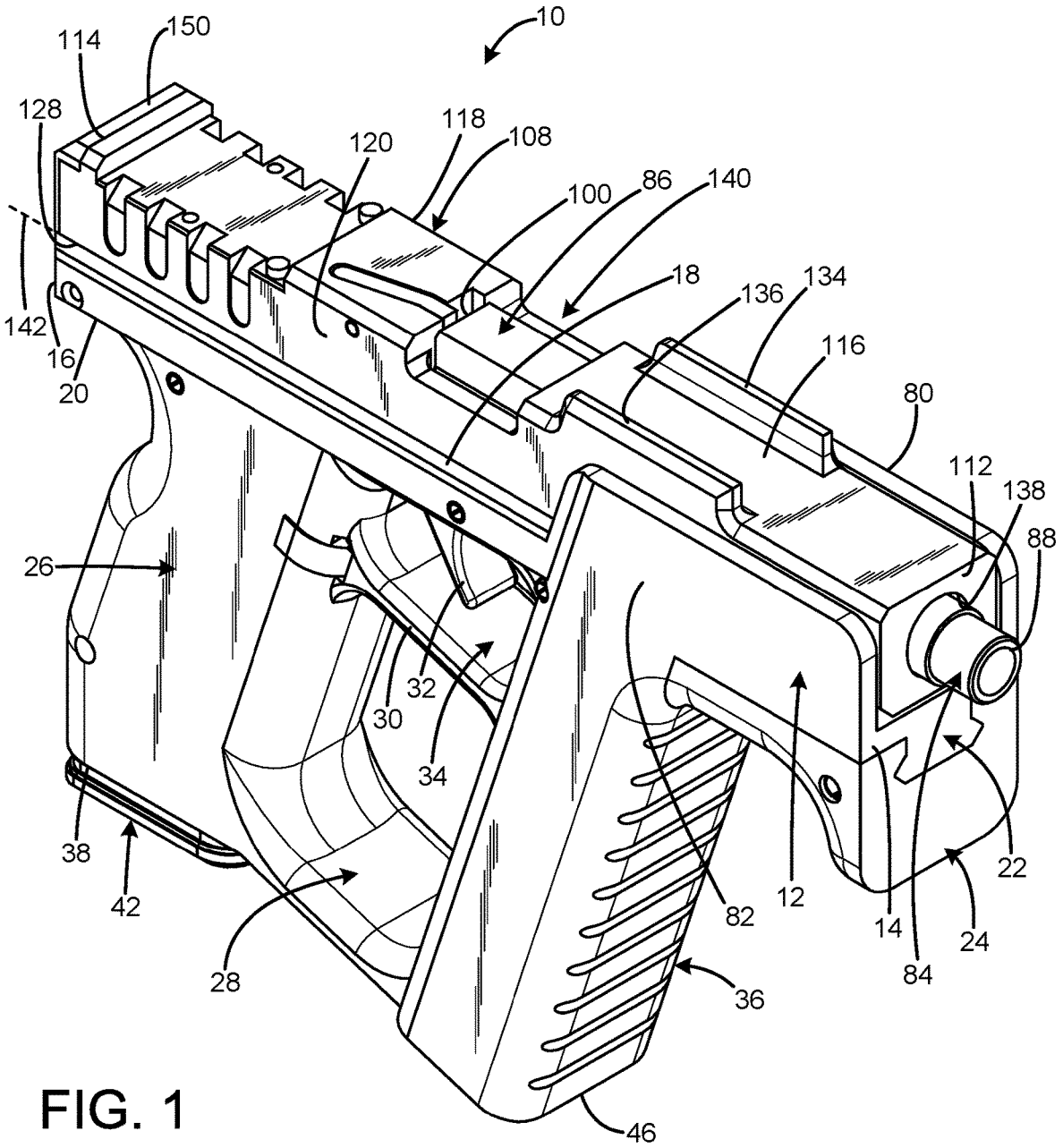
FIG. 1 is a front isometric view of the current embodiment of the firearm with recoil mitigation constructed in accordance with the principles of the present invention.
Figure 2:
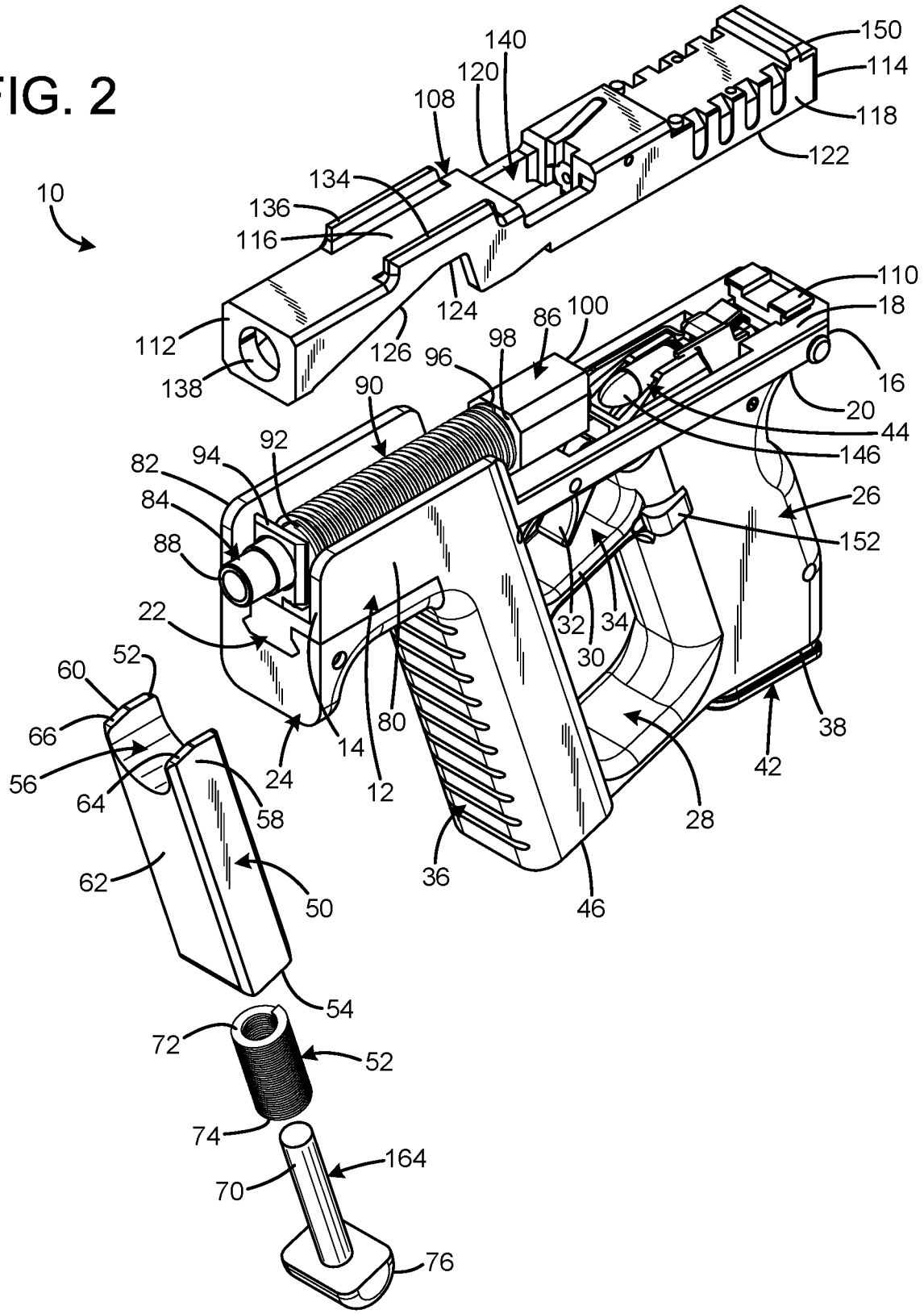
FIG. 2 is an exploded view of the current embodiment of the firearm with recoil mitigation of FIG. 1.

An embodiment of the firearm with recoil mitigation of the present invention is shown and generally designated by the reference numeral 10.

Figure 3:
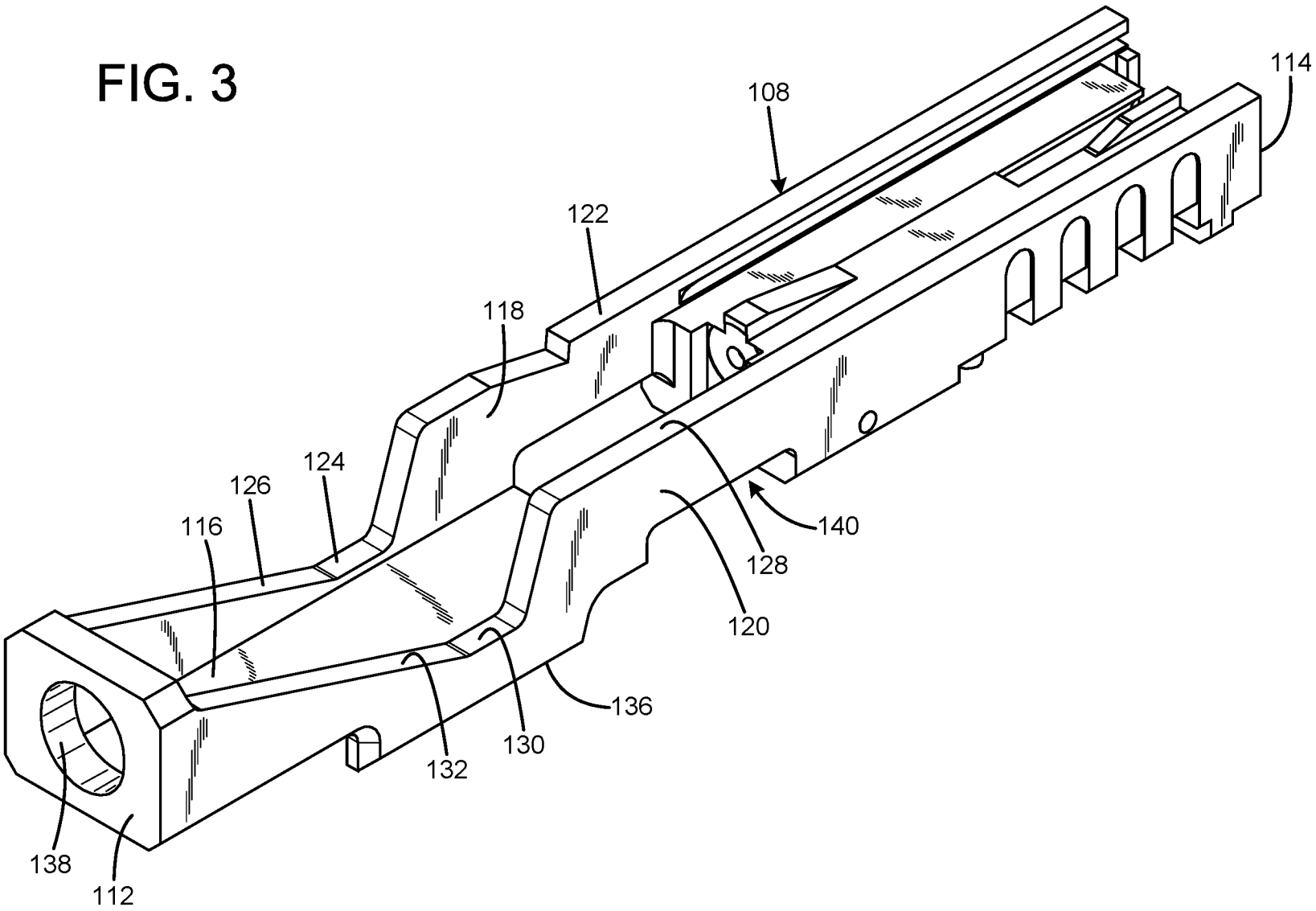
FIG. 3 is a front isometric bottom view of the current embodiment of the slide of FIG. 1.

FIGS. 1, 2, and 4-6 illustrate the improved firearm with recoil mitigation 10 of the present invention. FIG. 3 illustrates the improved slide 108 of the present invention. More particularly, the firearm with recoil mitigation has a frame 12 having a front 14, rear 16, top 18, and bottom 20. The bottom front of the frame includes a Picatinny rail 22 that releasably secures a hand stop 24 or a compatible accessory to the frame. The bottom rear of the frame forms a rear grip 26 adapted for gripping by a user, defines a rear grip aperture 28, and forms a trigger guard 30. A trigger 32 protrudes forwardly from the bottom of the frame into a trigger area 34 defined by the trigger guard. The bottom front of the frame behind the Picatinny rail forms a foregrip 36 adapted for gripping by a user. The bottom 38 of the rear grip defines a magazine well 40 that receives a magazine 42 loaded with cartridges 44. The bottom 46 of the foregrip defines a central bore 48 that receives a follower element 50, follower spring 52, and follower rod 164.

The follower element 50 has a top 52 and bottom 54. The top 52 defines a channel 56 that divides the top of the follower element into a left ear 58 and a right ear 60. The front 62 portion of the left ear defines a left slide contact portion 64, and the front portion of the right ear defines a right ear defines a right slide contact portion 66. The bottom of the follower element defines a central bore 68 that receives the shaft 70 of the follower rod 164. The central bore of the follower element is sized such that the top 72 of the follower spring abuts the bottom of the follower element and cannot enter the central bore of the follower element. The bottom 74 of the follower spring abuts the base 76 of the follower rod. In the current embodiment, the follower element has a mass of least 200 g and is biased with a spring force between 70 N and 116 N. The follower element is forward of and adjacent to the trigger area 34.

The front 14 of the frame 12 includes upwardly protruding left cover element 80 and right cover element 82. A barrel 84 having a chamber housing 86 and a muzzle 88 is received between the left and right cover elements. A recoil spring 90 is captured on the barrel with the front 92 of the recoil spring abutting a recoil spring retainer 94 and the rear 96 of the recoil spring abutting the front 98 of the chamber housing. The rear 100 of the chamber housing is open to enable a cartridge 44 to be loaded from the magazine 42 into the chamber 104 to result in a chambered cartridge 106. The channel 56 in the top 52 of the follower element 50 is sized to straddle the recoil spring 90.

A slide 108 is slidably mounted to the top 18 of the frame 14 by a slide rail 110. The slide has a front 112, rear 114, top panel 116, left side panel 118, and right side panel 120. The left and right side panels are opposed downwardly depending side panels. The left side panel has a left lower edge 122 that defines a left cutout 124 and a left ramp surface 126. The right side panel has a right lower edge 128 that defines a right cutout 130 and a right ramp surface 132. The left and right ramp surfaces are formed in the left and right cutouts above at least one of the left lower edge and right lower edge. The left side panel includes an upper left reinforcement 134 to strengthen the left side panel above the left cutout. The right side panel includes an upper right reinforcement 136 to strengthen the right side panel above the right cutout. The front of the slide defines a barrel aperture 138 that enables the muzzle 88 of the barrel 84 to protrude beyond the front of the slide. The top panel of the slide defines an ejection port 140 that is located behind the upper left and right reinforcements and is located above the chamber housing 86 when the firearm with recoil mitigation 10 is in the in battery condition. When the firearm with recoil mitigation 10 is in the in battery condition, the left cover element 80 and right cover element 82 serve as upwardly extending cover elements that cover the left cutout 124 and right cutout 130 to prevent dirt and debris from entering through the left and right cutouts. In the current embodiment, the follower element 50 has a mass at least 50% of the mass of the slide.

Figure 4:
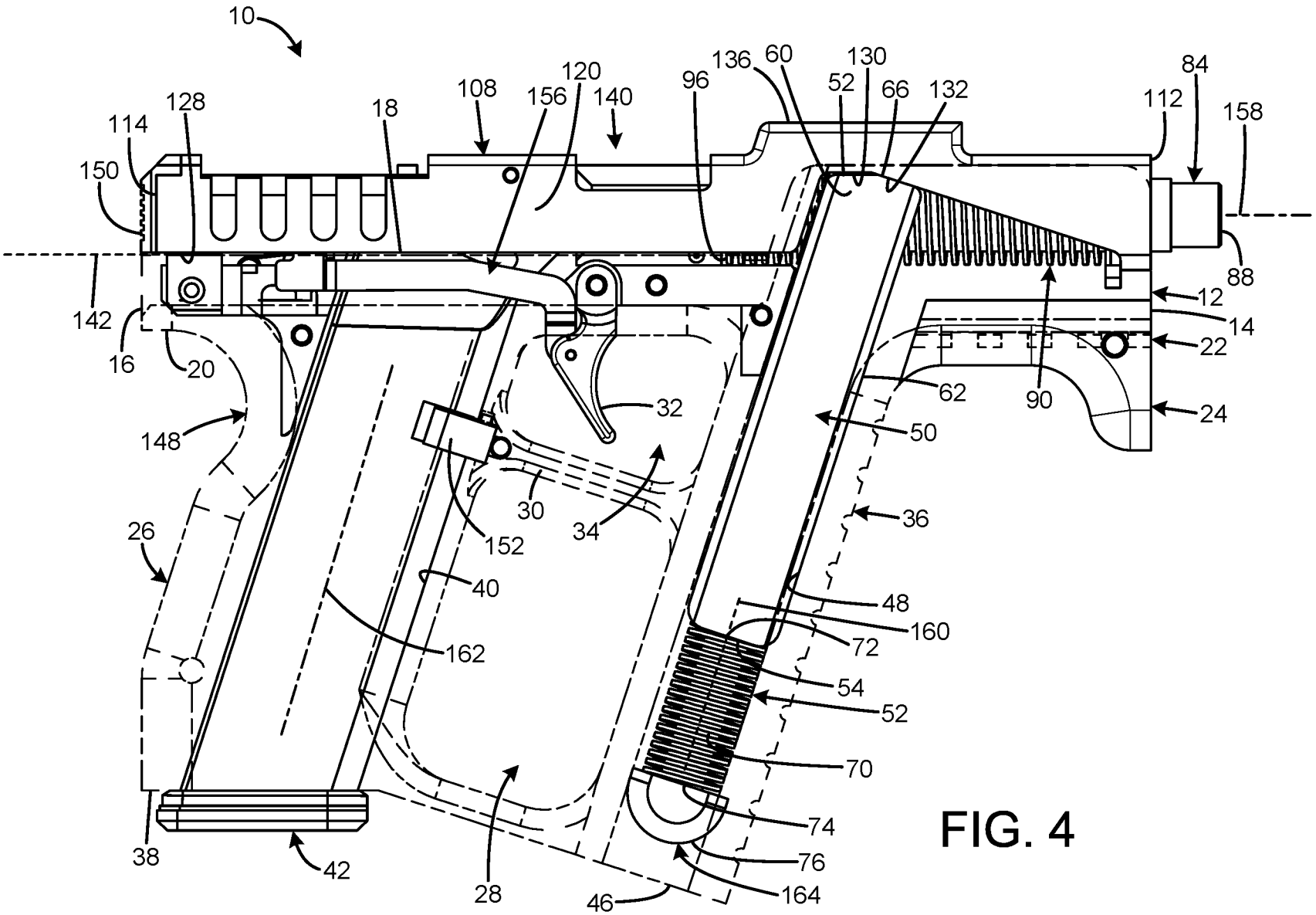
FIG. 4 is a side sectional view of the current embodiment of the firearm with recoil mitigation of FIG. 1 in the in battery condition with the frame in dashed lines.
Figure 5:
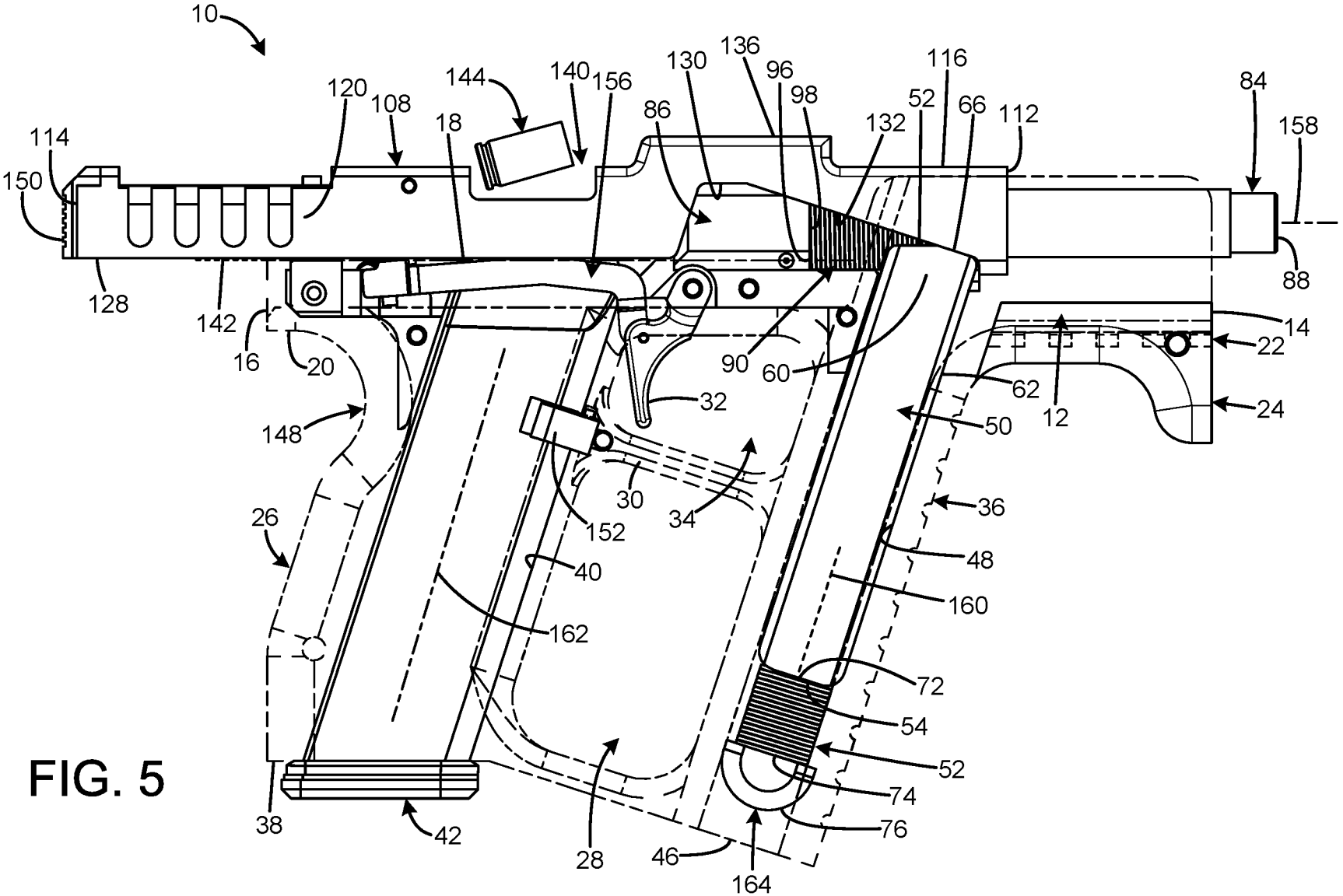
FIG. 5 is a side sectional view of the current embodiment of the firearm with recoil mitigation of FIG. 1 in the full recoil condition with the frame in dashed lines.
Figure 6:
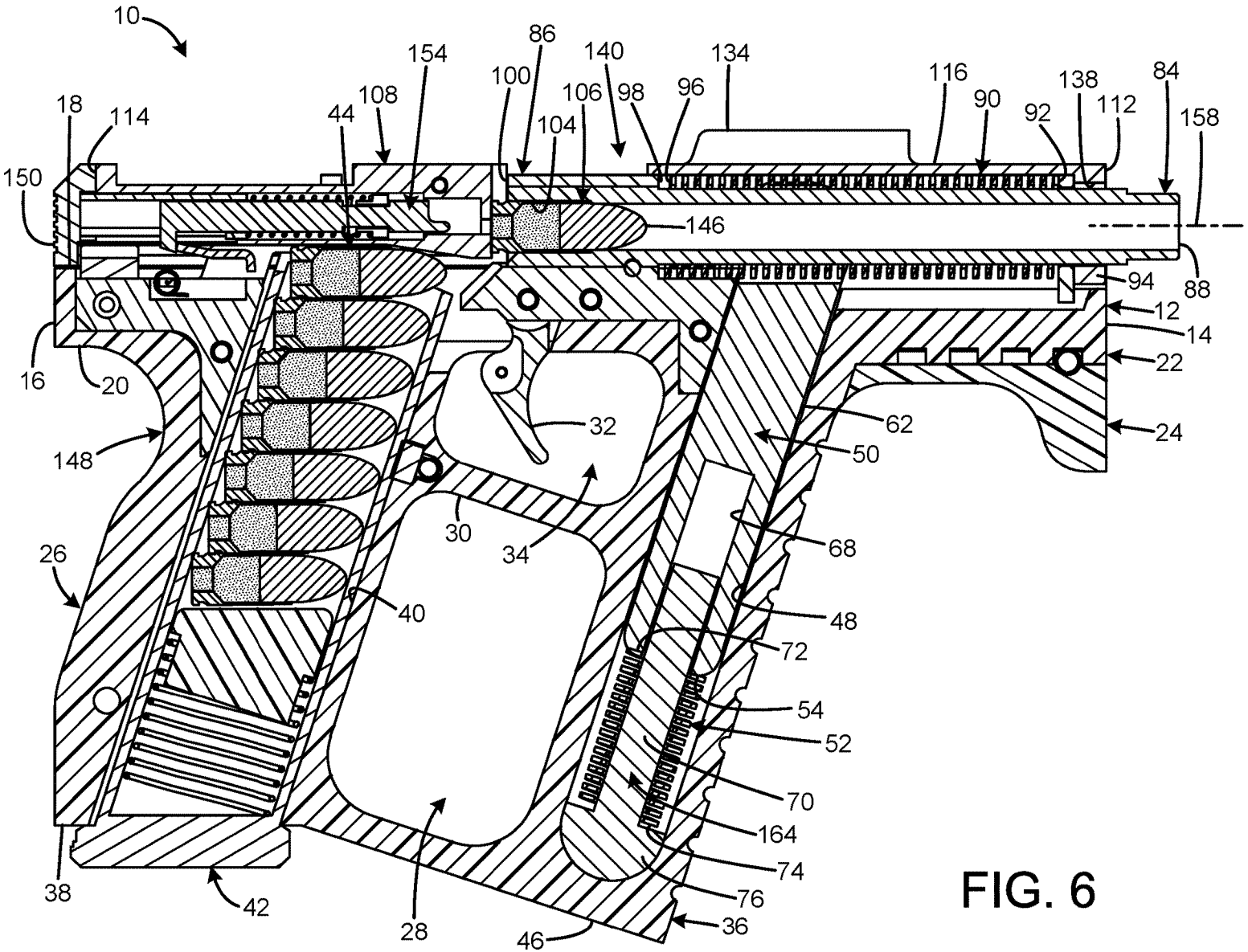
FIG. 6 is a side sectional view of the current embodiment of the firearm with recoil mitigation of FIG. 1 in the in battery condition.

The recoil mitigation features of the firearm with recoil mitigation 10 can be best appreciated by comparing FIGS. 4 & 5. In FIG. 4, the firearm with recoil mitigation 10 is depicted in the in battery condition. In FIG. 5, the firearm with recoil mitigation 10 is shown in the full recoil condition, with the slide 108 having traveled to its rearward most position along slide reciprocation path 142. The empty casing 144 has been extracted and ejected from the chamber 104, and the bullet 146 has left the barrel 84. In FIG. 5, the follower element 50 has been pushed downward and rearward along follower path 160 by the left and right ramp surfaces 126, 132 on the left and right lower edges 122, 128 of the slide contacting the left and right slide contact portions 64, 66 of the follower element. The follower spring 52 is compressed. The sum of the slide impulse vector and the follower element impulse vector is a resultant vector that passes through the pivot point 148 of the rear grip 26. The resultant vector is ideally in line with the user's strong arm, which prevents undesirable muzzle rise caused by the recoil forces resulting from discharge of the firearm with recoil mitigation 10. As the slide moves forward and feeds a new cartridge 44 from the magazine 42 into the chamber 104, the follower spring biases the follower element upwards toward the slide. Once there is a chambered cartridge 106 in the chamber, and the firearm with recoil mitigation 10 has returned to the in battery condition, the slide and follower element are in the positions shown in FIG. 4. Thus, reciprocation of the slide along the slide reciprocation path generates reciprocation of the follower element along the follower path. It should also be appreciated that the left and right ramp surfaces are angularly offset from the slide reciprocation path by a first angle. In the current embodiment, the first angle is greater than or equal to 10° and less than or equal to 45°, and the left and right ramp surfaces are straight lines. The reciprocation of the slide defines a horizontal plane, and the left and right ramp surfaces face downwardly and rearwardly. The follower path is angularly offset from the slide reciprocation path, is perpendicular to the left and right ramp surfaces, and is parallel to a grip axis 162 defined by the rear grip 26. The follower path is perpendicular to the left and right ramp surfaces to create a minimum friction condition to reduce wear on the slide and the follower element for a given amount of travel of the follower element. However, the follower path does not have to be perpendicular to the left and right ramp surfaces.

The firearm with recoil mitigation 10 is a handheld firearm that is capable of fully automatic fire, with an integrated recoil mitigation system to reduce muzzle climb and the effects of recoil. It can be fired with one or two hands. It is controllable during fully-automatic fire and more compact than competing designs. The small form factor is ideal for a personal defense weapon. It can fill roles currently occupied by submachineguns and machine pistols. It is striker-fired and accepts commonly available magazines. The slide 108 is milled to accept an optic. There are two bosses (left and right reinforcements 134, 136) protruding from the top panel 116 of the slide that can be used to cycle the action. The frame 12 has attachment points to accept a buttstock. The front section of the frame forms an angled foregrip 36. There is hand stop 24 on the fore-end of the firearm that can be removed to reveal a Picatinny rail 22. Because the barrel 84 is fixed relative to the frame, and the recoil mitigation system does not rely on the redirection of gases, the firearm is compatible with suppressors without the need for a linear inertial decoupler.

In the current embodiment, the firearm with recoil mitigation 10 has a polymer frame. The frame is similar to other modern polymer frames except it has an extra, hollow section (central bore 48 at the front which houses the follower element 50. Attached to the frame with pins are a trunnion, rail housing, and the hand stop 24. The barrel 84 is pinned to the trunnion. The slide rides along the barrel and trunnion in the front, and the slide rail 110 in the rear. The slide rail is a small block that is captured in the slide by an end plate 150. The slide rail is secured to the rail housing with a takedown pin. The barrel captures the follower element. The recoil spring retainer 94 captures the recoil spring.

To operate the firearm with recoil mitigation 10, the firearm is held with the user's strong hand on the rear grip 26. The user pushes the magazine 42 into the magazine well 40 until the magazine is locked in place by the magazine catch 152. The user pulls the slide 108 all the way back and releases it. The slide strips a cartridge 44 from the magazine and pushes the cartridge into the chamber 104. The striker 154 is held back by the spring-loaded trigger bar 156. The follower element 50 is held in the highest point of travel by the follower spring 52. The firearm is now ready to fire. The user holds the angled foregrip 36 with the support hand. The user aims at the target and pulls the trigger 32 back. The trigger pushes the trigger bar rearward. The sear surface of the trigger bar rides against the angled sear surface on the slide. When the trigger bar has traveled far enough downward, the striker becomes free to move forward. The striker impacts the primer of the chambered cartridge 106 and ignites the powder.

The expanding gases produced by the burning powder push the bullet 146 forward and the slide 108 rearward. As the slide moves rearward, the left and right ramp surfaces 126, 132 cam the follower element 50 downward and rearward in the central bore 48 in the foregrip 36. The follower element retards the rearward movement of the slide. The bullet exits the barrel 84 while the slide and follower element are still moving. The empty casing 144 impacts the ejector and gets ejected from the firearm through the ejection port 140. The slide and follower element continue moving until their respective springs (recoil spring 90 and follower spring 52) are fully compressed. At the end of the slide's travel, the slide imparts an impulse vector in line with the path of the slide's center of mass. At almost the exact same moment, the follower element imparts its own impulse vector in line with the path of the follower element's center of mass. The sum of these vectors is a resultant vector that points downward and rearward from the bore axis 158 defined by the barrel. If the resultant vector points above the user's strong arm, then there will be a resultant moment that twists the muzzle 88 upward, but not as much as a conventional blowback handgun. If the resultant vector points below the user's strong arm, then there will be a resultant moment that twists the muzzle downward. If the masses of the slide and follower element are tuned precisely, then the resultant recoil vector will be in line with the user's strong arm, there will be no significant resultant moment, and the muzzle will not twist upward or downward.

The slide 108 then begins to travel forward again, and the follower element 50 moves upward and forward. The slide strips a new cartridge 44 from the magazine. The striker 154 is again held back by the trigger bar 156. The slide pushes the cartridge into the chamber 104. When the slide is almost at the foremost extent of travel, the angled sear surface on the slide pushes the sear surface of the trigger bar downward. The striker releases and impacts the primer of the cartridge. The firing cycle repeats until the magazine 42 is empty, or the user releases the trigger 32.

While a current embodiment of a firearm with recoil mitigation has been described in detail, it should be apparent that modifications and variations thereto are possible, all of which fall within the true spirit and scope of the invention. For example, the firearm could incorporate drop safeties or manual safeties. The trigger mechanism could be made select-fire or semi-automatic. The follower element could contain interchangeable weights. The follower element could travel at a different angle relative to the barrel. The follower element and trunnion could be grooved to directly align with each other. The follower element and/or its path of travel could be non-linear. The follower element and slide could be mechanically linked. There could be rollers positioned between sliding parts. The contact surface between the slide and the follower element could be non-planar. The firearm could include iron sights. The firearm could include an additional, stronger buffer spring in-line with the recoil spring and/or follower spring. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm comprising:

a frame;

a slide connected to the frame;

the slide configured to reciprocate relative to the frame along a slide reciprocation path;

the slide having a ramp surface angularly offset from the slide reciprocation path by a first angle;

a follower element connected to the frame and configured to reciprocate along a linear follower path with respect to the frame;

the follower being biased toward the slide;

the follower having a slide contact portion configured to contact the ramp surface of the slide, such that reciprocation of the slide generates reciprocation of the follower element; and wherein the follower path is angularly offset from the slide reciprocation path.

2. The firearm of claim 1 wherein the reciprocation of the slide defines a horizontal plane, and the ramp surface faces downwardly and rearwardly.

3. The firearm of claim 1 wherein the slide includes a top panel and opposed downwardly-depending side panels each having lower edges, and wherein the ramp surface is formed in a cutout above the lower edge of one of the side panels.

4. The firearm of claim 3 wherein the frame includes an upwardly extending cover element covering the cutout.

5. The firearm of claim 3 including a cutout on each side panel.

6. The firearm of claim 1 wherein the ramp surface is angularly offset from the slide reciprocation path by between 10 and 45 degrees.

7. The firearm of claim 1 wherein the ramp surface is a straight line.

8. The firearm of claim 1 wherein the follower element has a mass of at least 200 g.

9. The firearm of claim 1 wherein the follower element is biased with a spring force between 70 N and 116 N.

10. The firearm of claim 1 wherein the follower path is perpendicular to the ramp surface.

11. The firearm of claim 1 wherein the follower element has a mass at least 50% of a mass of the slide.

12. The firearm of claim 1 wherein the frame includes a grip defining a grip axis and wherein the follower path is parallel to the grip axis.

13. The firearm of claim 1 wherein the frame defines a trigger area and wherein the follower element is forward of the trigger area.

14. The firearm of claim 1 wherein the frame defines a trigger area and wherein the follower is adjacent to the trigger area.

15. A firearm comprising:

a frame;

a slide connected to the frame;

the slide configured to reciprocate relative to the frame along a slide reciprocation path;

the slide having a ramp surface angularly offset from the slide reciprocation path by a first angle;

a follower element connected to the frame and configured to reciprocate with respect to the frame along a follower path; the follower being biased toward the slide;

the follower element having a top;

the top having a channel dividing the top into a left ear and a right ear;

each of the left ear and right ear having a slide contact portion; and the slide contact portions are configured to contact the ramp surface of the slide, such that reciprocation of the slide generates reciprocation of the follower element.

* * * * *